US009829908B2

(12) United States Patent
Roberts et al.

(10) Patent No.: US 9,829,908 B2
(45) Date of Patent: Nov. 28, 2017

(54) BIDIRECTIONAL PEDAL ASSEMBLY

(71) Applicant: Kongsberg Power Products Systems Ltd., Basildon (GB)

(72) Inventors: Timothy Roberts, Southend (GB); Simon Mills, Little Braxted (GB)

(73) Assignee: KONGSBERG POWER PRODUCTS SYSTEMS LTD., Essex (GB)

( * ) Notice: Subject to any disclaimer, the term of this patent is extended or adjusted under 35 U.S.C. 154(b) by 36 days.

(21) Appl. No.: 14/784,490

(22) PCT Filed: Apr. 1, 2014

(86) PCT No.: PCT/EP2014/056513
§ 371 (c)(1),
(2) Date: Oct. 14, 2015

(87) PCT Pub. No.: WO2014/170126
PCT Pub. Date: Oct. 23, 2014

(65) Prior Publication Data

US 2016/0070292 A1 Mar. 10, 2016

Related U.S. Application Data

(60) Provisional application No. 61/812,058, filed on Apr. 15, 2013.

(51) Int. Cl.
*G05G 1/30* (2008.04)
*G05G 5/03* (2008.04)
(Continued)

(52) U.S. Cl.
CPC ..... *G05G 1/445* (2013.01); *G05G 5/03* (2013.01); *G05G 5/05* (2013.01)

(58) Field of Classification Search
CPC ..... G05G 1/30; G05G 1/44; G05G 1/445; G05G 5/03; G05G 5/05; B60T 7/04
(Continued)

(56) References Cited

U.S. PATENT DOCUMENTS 2,042,202 A * 5/1936 Althouse ..... B60W 10/18 477/216
2,482,550 A * 9/1949 Koertge ..... H01H 21/26 200/86 R
(Continued)

FOREIGN PATENT DOCUMENTS

| | | |
|---|---|---|
| CH | 690909 A5 | 2/2001 |
| EP | 2228705 A2 | 9/2010 |
| EP | 1857909 B1 | 8/2011 |

OTHER PUBLICATIONS

International Search Report dated Jul. 3, 2014 for International Application No. PCT/EP2014/056513.
(Continued)

*Primary Examiner* — Adam D Rogers
(74) *Attorney, Agent, or Firm* — Howard & Howard Attorneys PLLC

(57) ABSTRACT

One embodiment of a bidirectional pedal assembly includes a base structure connectable to a vehicle structure and a pedal support member pivotally mounted on the base structure to be pivotable around an axis of rotation from a rest position in a first direction and in a second direction opposite to the first direction. First and second spring elements to urge the pedal support member to its rest position. First and second frictional mechanisms are disposed between the pedal support member and the first and second springs, such that the first and second frictional mechanisms, respectively, moves with the pedal support member and transmits force from the pedal support member to one of the first and second spring elements. Each frictional mechanism is arranged to increase a frictional resistance to retard pivotal movements of the pedal support member upon force being transmitted through the respective frictional mechanism.

25 Claims, 17 Drawing Sheets

(51) Int. Cl.
*G05G 5/05* (2006.01)
*G05G 1/445* (2008.04)

(58) Field of Classification Search
USPC ..... 74/561
See application file for complete search history.

(56) References Cited

U.S. PATENT DOCUMENTS

| | | | | |
|---|---|---|---|---|
| 2,483,224 | A * | 9/1949 | Narcovich | G05G 1/445 477/215 |
| 4,250,768 | A * | 2/1981 | Hildebrecht | B60W 10/06 74/473.16 |
| 4,887,701 | A * | 12/1989 | Van Der Vliet | B60W 10/04 477/207 |
| 5,673,589 | A * | 10/1997 | Arao | B60T 7/06 74/512 |
| 6,575,053 | B2 | 6/2003 | Menzies | |
| 6,722,225 | B1 * | 4/2004 | Martinovsky | G05G 1/00 74/512 |
| 6,931,962 | B2 * | 8/2005 | Maurer | G05G 1/30 74/491 |
| 8,266,982 | B2 | 9/2012 | Peniston et al. | |
| 2003/0010147 | A1 | 1/2003 | Maurer et al. | |
| 2008/0173124 | A1 | 7/2008 | Thiel et al. | |

OTHER PUBLICATIONS

Computer-generated English Translation of CH 690909 A5 obtained from Espacenet on Oct. 13, 2015.

* cited by examiner

BIDIRECTIONAL PEDAL ASSEMBLY

The present invention relates to a bidirectional pedal assembly comprising: a base structure connectable to a vehicle structure; a pedal support member pivotally mounted on the base structure to be pivotable around an axis of rotation from a rest position in a first direction and in a second direction opposite to the first direction; first and second spring elements which are tensioned when the pedal support member is pivoted in the first and second direction, respectively, and which urge the pedal support member to its rest position.

A bidirectional pedal assembly of this kind is disclosed in U.S. 2008/0173124 A1. Bidirectional pedal assemblies are often used in vehicular applications (for example trucks and utility vehicles) to control vehicle operations. Such pedal assemblies are also known as rocker pedal assemblies. Traditionally such pedal systems have been used with hydraulic or other direct force transmission means from the pedal system to the part of the vehicle where a control movement had to be applied. Recently also electronic pedal systems have been utilized. In such electronic pedal system the position of the pedal with respect to a fixed base part of the pedal assembly is sensed by a sensor, and the position signal of the sensor is transmitted electrically to the part of the vehicle which is to be controlled by the pedal system. In such electronic pedal systems in which the pedal positioning is sensed by sensor and the corresponding control command is sent electrically, the user of the pedal system does not have sufficient feedback to have a feeling for the strength of the control command caused by pushing down the pedal. Such feedback can be provided to a certain extent by springs which act between the moveable pedal and a fixed portion of the base structure such that the force needed to push down the pedal increases the further the pedal is pushed down.

In addition to the spring force it is desired to provide frictional forces designed to give a user the impression of a mechanical pedal assembly. For such purposes so called hysteresis mechanisms are provided which are formed by friction generating means in combination with the spring forces to provide the impression of a mechanical pedal assembly and to provide a return force intended both to give the impression of a mechanical pedal and to bias the pedal back to its rest position when it is released. An example for a hysteresis mechanism for a simple one-directional pedal assembly is described in EP 1 857 909 B1. In this pedal assembly the friction generating mechanism is disposed between the pedal and the spring which urges the pedal to its rest position. The force from the pedal, when it is pivoted down, is transferred through the friction generating mechanism to the spring. The frictional mechanism comprises two hysteresis blocks having a sloping interface such that, when a force is transferred though the frictional mechanism the sloping interface between the blocks causes a force transverse to the force being transmitted through the frictional mechanism. This transverse force between the hysteresis blocks is used to press a fictional surface of one of the hysteresis blocks against a counter-surface to increase frictional resistance when the pedal is pivoted.

The above-mentioned U.S. 2008/0173124 A1 also mentions hysteresis for the bidirectional pedal assembly, but it is described that it is a biasing member (which returns the pedal back to its rest position) which is the one which may also provide hysteresis. However, this is not the hysteresis effect described above since a biasing member can only give a position dependent counter-force but no frictional forces which should be produced in order to give the impression of a mechanical pedal.

It is an object of the present invention to provide a bidirectional pedal assembly which is capable of providing the impression of a mechanical pedal assembly. It is a further object of the invention to provide a bidirectional pedal assembly of save and compact design.

According to the present invention the pedal assembly has a base structure which is arranged to be connected to a vehicle structure. A pedal support member is pivotally mounted on base structure to be pivotable around an axis of rotation from a rest position in a first direction and in a second direction opposite to the first direction. First and second spring elements are provided which are arranged to be tensioned when the pedal support member is pivoted in the first and second directions, respectively. These first and second spring elements also urge the pedal support member back to its rest position. The pedal support member, when pivoted, exerts a force on and tensions one of the first and second springs. First and second frictional mechanisms are disposed between the pedal support member and the first and second spring elements, respectively. When the pedal support is pivoted in the first and second directions, the first and second frictional mechanisms, respectively, move with the pedal support member and act on the first and second spring elements, respectively, by transmitting force from the pedal support member through the first and second frictional mechanisms, respectively, to the first and second spring elements. This means that the force exerted by the pedal support member on one of the first and second spring elements is transferred through the corresponding one of the first and second frictional mechanisms to the spring elements. The first and second frictional mechanisms are arranged to increase a frictional resistance against the movement of the respective frictional mechanism caused by the pedal support member to retard pivotal movements of the pedal support member upon force being transmitted through the respective frictional mechanism.

In a preferred embodiment the first and second frictional mechanisms each comprise at least two members which are in abutment with and moveable to each other and which are arranged to be urged apart upon force being transmitted through the respective frictional mechanism. This movement of the frictional members apart from each other is utilized to thereby increase a frictional resistance against the movement of the frictional mechanism caused by the pedal support member to retard pivotal movements of the pedal support member. In particular the first and second frictional mechanisms can be arranged such that, when its two members are urged apart in transverse direction to the force direction transmitted through the first and second frictional mechanisms, at least one surface of one of the at least two members is pressed against a counter-surface which is fixed in relation to the base structure. This increases the frictional resistance of the movement of the first and second frictional mechanisms caused by pivotal movements of the pedal support member in the first and second opposite directions. Since the movement of the first and second frictional mechanisms caused by the pivotal movements of the pedal support member is retarded by increased frictional resistance, also the pivotal movements of the pedal support member are retarded or slowed down correspondingly.

The first and second frictional mechanisms are provided to retard pivotal movements of the pedal support member, i.e. to increase the force, preferably proportionally increasing with respect to pedal support member rotation, needed to pivot the pedal support member away from its rest position over the force needed to tension the spring elements, and provide a counter-force to the spring force when the springs urge the pedal support member back to the rest position, which means that the spring elements have to overcome the additional frictional force created by the frictional mechanism when the spring force is transmitted through the friction mechanism to the pedal support member to urge it back to its rest position. Therefore, the return force experienced by the pedal support member is lowered compared to the spring force by the fictional force of the frictional mechanism.

In a preferred embodiment each of the first and second frictional mechanisms is arranged such that, when its at least two members are urged apart in transverse direction upon force transmission in longitudinal direction, at least one surface of one of the members is pressed against a surface which is stationary in relation to the base structure to increase the frictional resistance against pivotal movements of the pedal support member.

In a preferred embodiment the at least two members of each of the first and second frictional mechanisms have surface portions in abutment with each other which are inclined with respect to a plane perpendicular to the direction in which force is transmitted from the pedal support member through the respective frictional mechanism, whereby the at least two members are urged apart by a wedging interaction of the inclined surface portions. The force urging the at least two members of the frictional mechanisms transversely apart upon force transmission in longitudinal direction can be adapted by choosing the area of the inclined surface portions in abutment, and by choosing the angle of inclination of the inclined surface portions with respect to the plane perpendicular to the longitudinal direction of force transmission.

In a preferred embodiment each of the first and second frictional mechanisms comprises a central member having inclined side margin portions, and two opposite side members, each of the side members having an inclined surface portion for abutment on a respective one of the inclined margin portions of the central member. Each side member has an outer surface wall facing an inner wall surface of the base structure, whereby the two side members, when force is transmitted in longitudinal direction through the respective frictional mechanism, are pressed in opposite directions away from the central member and thereby with their outer side surfaces pressed into frictional engagement with inner wall face portions of the base structure. Preferably, the central members of each of the first and second frictional mechanisms are connected to the first and spring elements, respectively, and the pedal support member is arranged to exert force, when pivoted out of the rest position in a first or opposite second direction, on the side members of the first or second frictional mechanisms, respectively, which force is transferred via the central member to the first or second spring elements, respectively.

Preferably stop surfaces are provided that balance the forces of the first and second spring elements on the first and second frictional mechanisms, respectively, when the first and second frictional mechanisms reach their rest position corresponding to the rest position of the pedal support member by abutment of the stop surfaces on the first and second frictional mechanism, respectively. In this manner the stop surfaces decouple force transfer between the first and second spring elements through the first and second frictional mechanisms, respectively, to the pedal support member once the respective frictional mechanism reaches its rest position. That means the stop surfaces prevent that the first and second frictional mechanisms could move beyond the position they reach when the pedal support member reaches its rest position.

In particular the stop surfaces are provided such that the pedal support member, at any point of its pivotal movement path, is urged back to its rest position by first and second spring elements, regardless of any difference in the force exerted by the first and second spring elements because the stop surfaces are arranged such that a decouple force transfer from the first and second spring elements to the pedal support member in the rest position by preventing movement of the first and second frictional mechanisms, respectively, from moving beyond their rest positions corresponding to the rest position of the pedal support member. This means that if there is a difference between the forces exerted by the first and second spring elements on the pedal support member, the spring elements which exert a stronger force can not move the pedal support member beyond its rest position because the movement of the frictional mechanism driven by the stronger spring elements is stopped once the rest position of the pedal support member is reached.

The stop surfaces can for example be formed by flanges which are fixed in relation to the base structure.

The central member of the first and second frictional mechanisms can for example be made of polyphenylene sulphide (PPS), and the side members sliding thereon can be made of polyoxymethylene (POM).

The invention will be further described in the following description of particular embodiments in connection with the drawings in which.

Figure 1:
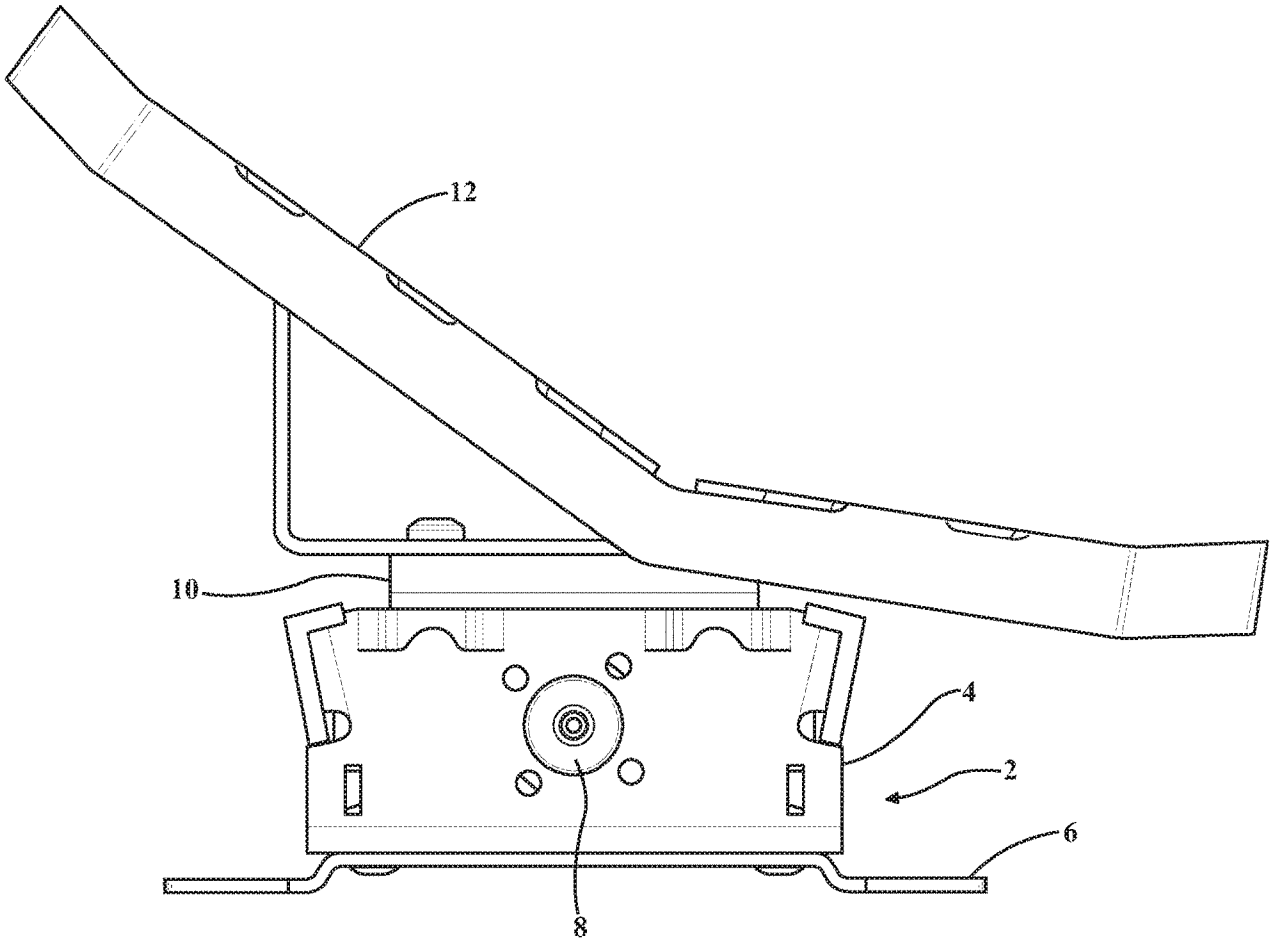
FIG. 1 shows a side view of a bidirectional pedal assembly according to a first embodiment.

FIG. 1 shows a schematical side view of a pedal assembly according to a first embodiment. The pedal assembly comprises a pedal 12 mounted on a pedal support member 10. The pedal support member 10 in turn is pivotally mounted by means of a shaft 8 in a base structure 2. The base structure 2 is adapted to be connected to a fixed structure of a vehicle, for example to the floor of a vehicle cabin. The base structure 2 comprises a base mounting plate 6 on which a base housing 4 can be fixed, for example by means of screws.

Figure 3:
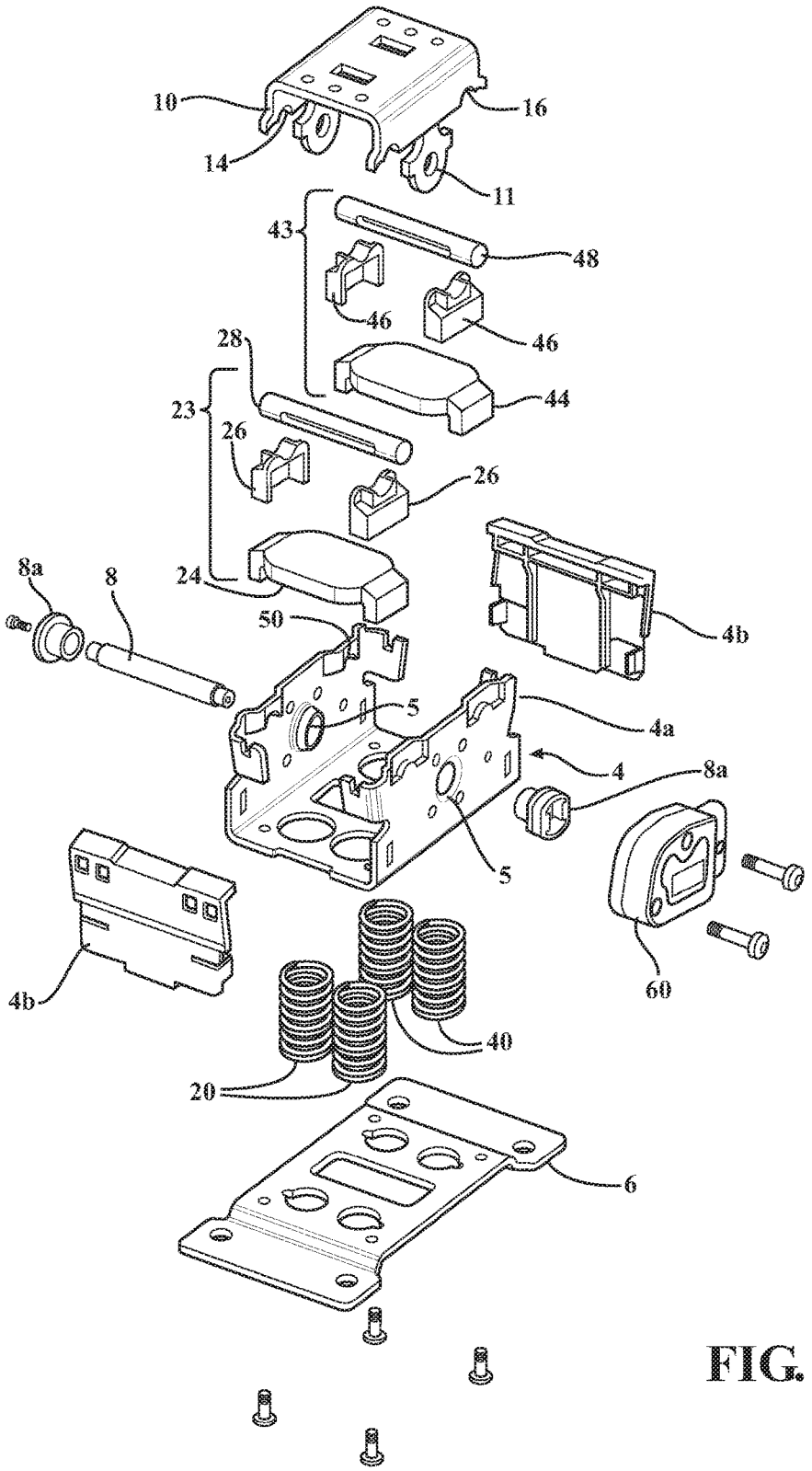
FIG. 3 shows an exploded view of the pedal assembly according to the first embodiment.

Further components of the pedal assembly according to the first embodiment will be described in connection with the exploded view in FIG. 3. The components of the base structure are the base mounting plate 6 on which a housing bracket 4*a* of the base housing can be fixed. End walls 4*b* of the base housing can be fixed to the base housing bracket 4*a*. The base housing bracket 4*a* has opposite through openings 5 adapted to receive a shaft 8. The shaft 8 is inserted after spring elements 20 and second spring elements 40 are mounted and after first and second frictional mechanisms 23, 43 are assembled. The first frictional mechanism 23 comprises a central member 24, two side members 26 and a transfer pin 28. The second frictional mechanism 43 comprises a central member 44, two opposite side members 46 and a transfer pin 48.

The pedal support member 10 is disposed in the housing bracket 4*a* such that opposite openings 11 in side wall extensions of the pedal support member 10 are aligned with the opposite openings 5 in the housing bracket 4*a*. After inserting the shaft 8 such it is extends through openings 5 and 11, shaft and end caps 8*a* are mounted at the ends of the shaft 8 to fix it against movements in the longitudinal direction of the shaft 8. Furthermore, a sensor 60 is mounted to one of the end caps fixed to the shaft 8 such that the sensor rotates with the shaft 8. The sensor 60 serves to provide a signal indicative of the rotational position of the shaft 8 with respect to the fixed base structure 2. The sensor 60 can for example include sensors which are sensitive to magnetic flux, and magnet elements can be provided on the base structure such that the sensor sensitive to magnetic flux provides a signal indicative of the rotational position of the shaft 8 and thus of the pedal support member 10 with respect to the base structure. For further details of the sensor 60 and its way of operation reference is made to EP 1 857 909 B1.

Figure 2:
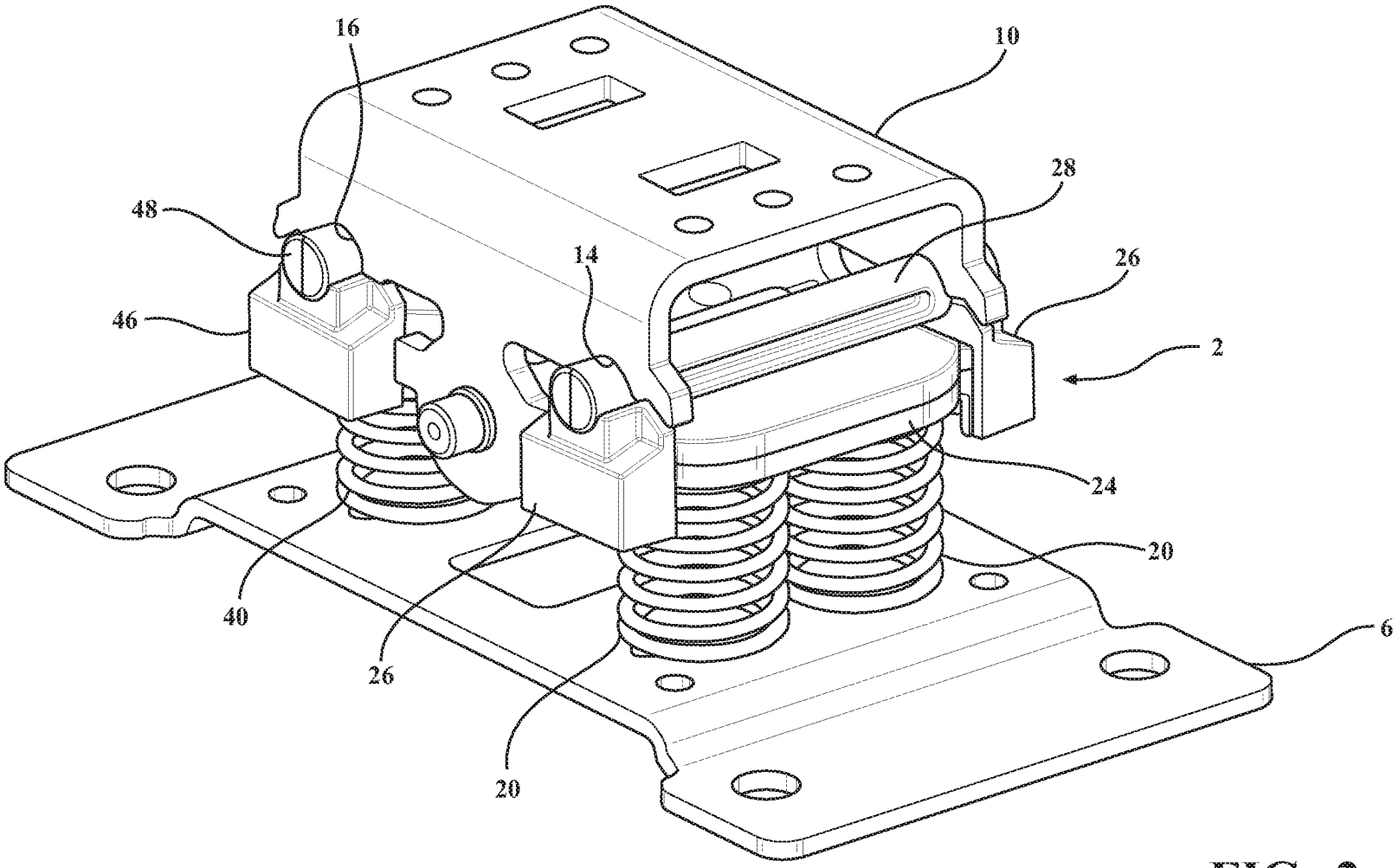
FIG. 2 shows a perspective view of the inner components of the pedal assembly according to the first embodiment.
Figure 6:
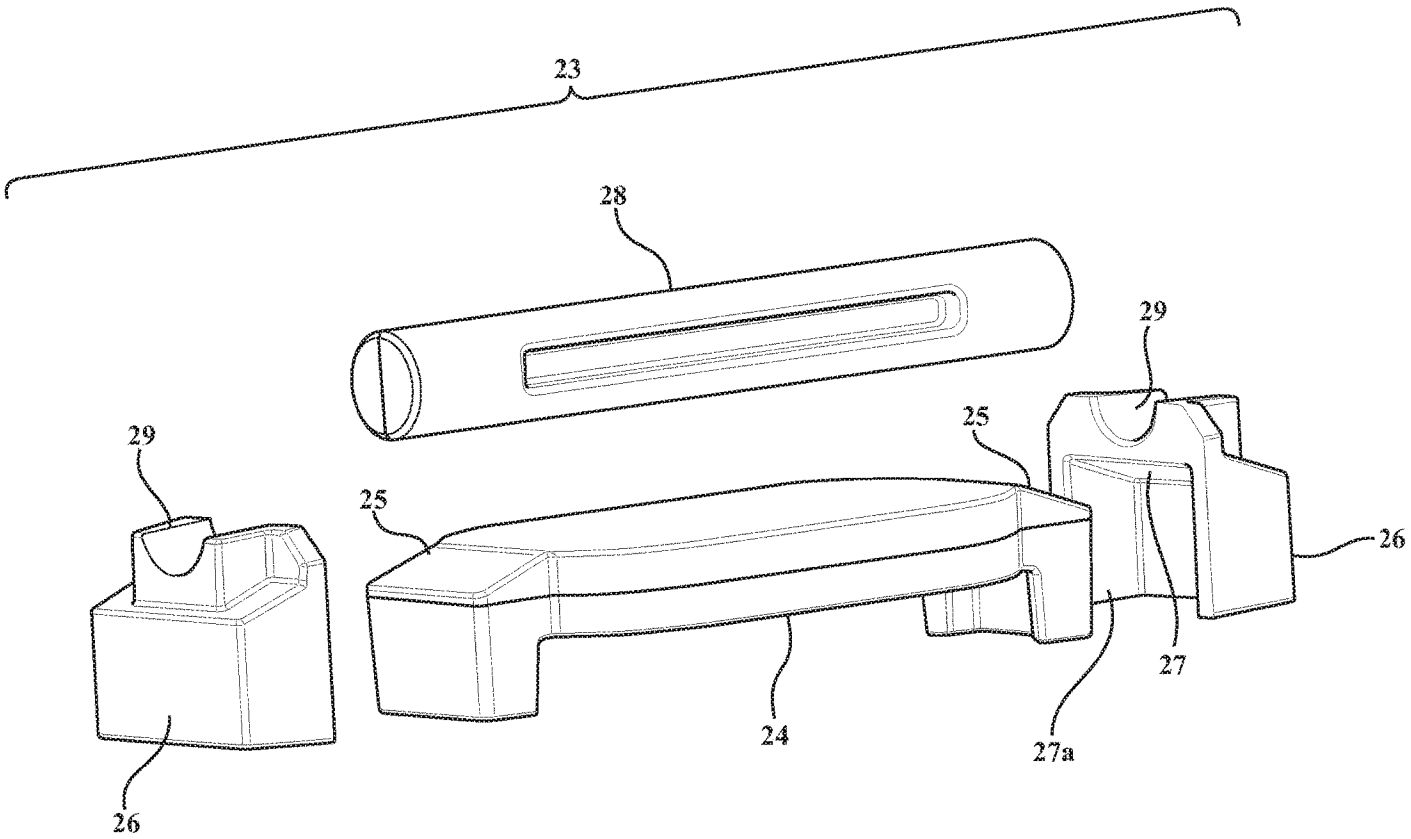
FIG. 6 shows a perspective exploded view of components of the frictional mechanism according to the first embodiment.

FIG. 2 shows a perspective view of parts of the pedal assembly according to the first embodiment, wherein the base housing 4 has been removed to show the components inside of the housing in the assembled state. The base mounting plate 6 carries two first spring elements 20 on one side and two second spring elements 40 on a second, opposite side. The first frictional mechanism 23 comprises the central member 24 which is connected to the upper end of the first spring element 20. The first friction mechanism 23 further comprises two opposite side members 26 arranged symmetrically on both sides of the central member 20. Details of the first friction mechanism 23 can be seen in the exploded view of FIG. 6. The central member 24 comprises inclined margin portions 25 at both opposite ends. The side members 26 have a hollow recess with an inclined upper wall portion 27 which is inclined or sloped at the same angle as the inclined margin portions 25 of the central member 24. The inner recesses 27*a* of the side members 26 receive the opposite end portions of the central member 24 such that the inclined margin portions 25 are in abutment with the inclined upper wall portions 27 of the side members 26. Side members 26 furthermore have semi-cylindrical recesses 29 in their upper portions to receive a cylindrical transfer pin 28.

Turning back to FIG. 2 it can be seen that the pedal support member 10 is provided with semi-circular recesses 14 and 16 which surround the upper part of the transfer pins 28 and 48 but are not connected to the transfer pins 28 and 48. When the pedal support member 10 is pivoted in a first direction around the shaft 8 it exerts force on the transfer pin 28. The transfer pin 28 transfers this downwardly directed force to the side members 26 which in turn transfer this force to the central member 24 through the inclined interface formed between the inclined margin portions 25 of the central member and the inclined upper wall portions 27 of the side members 26.

Figure 4:
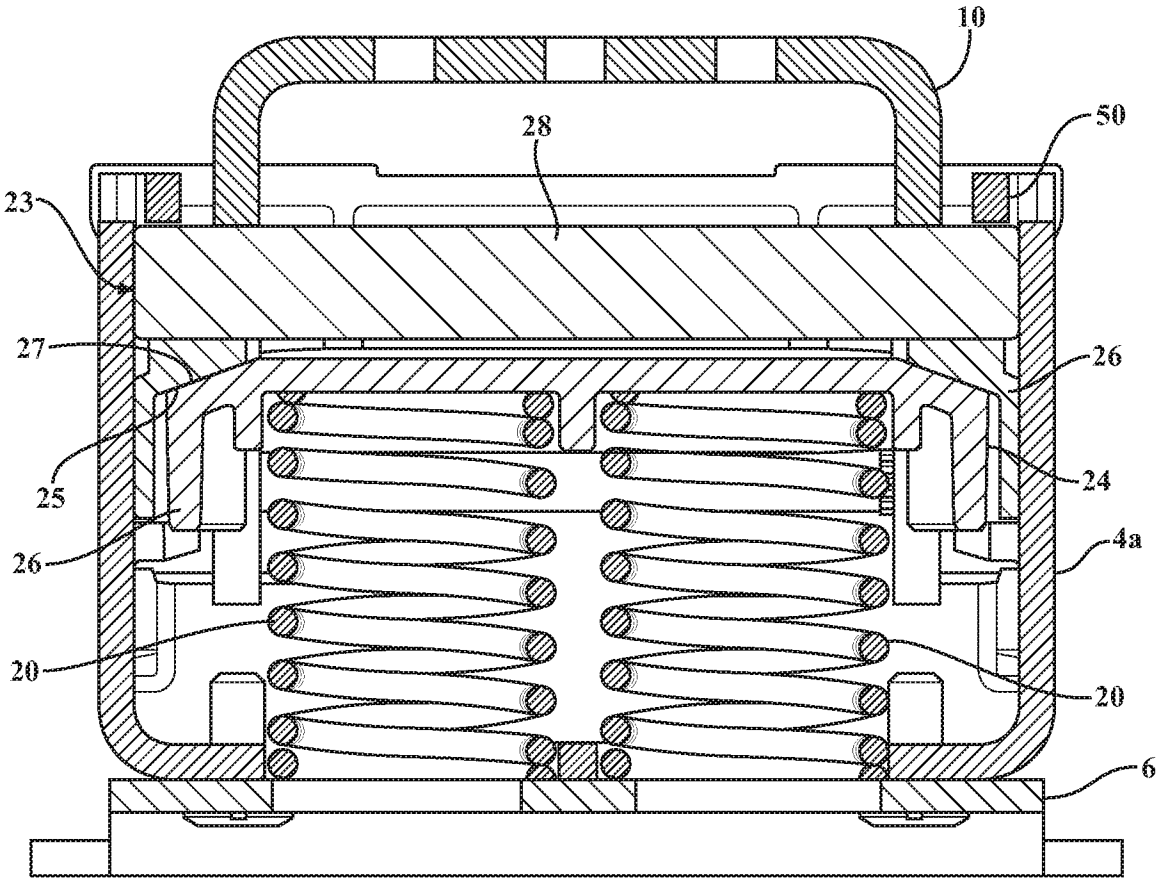
FIG. 4 shows a cross sectional view of the bidirectional pedal assembly according to the first embodiment.
Figure 5:
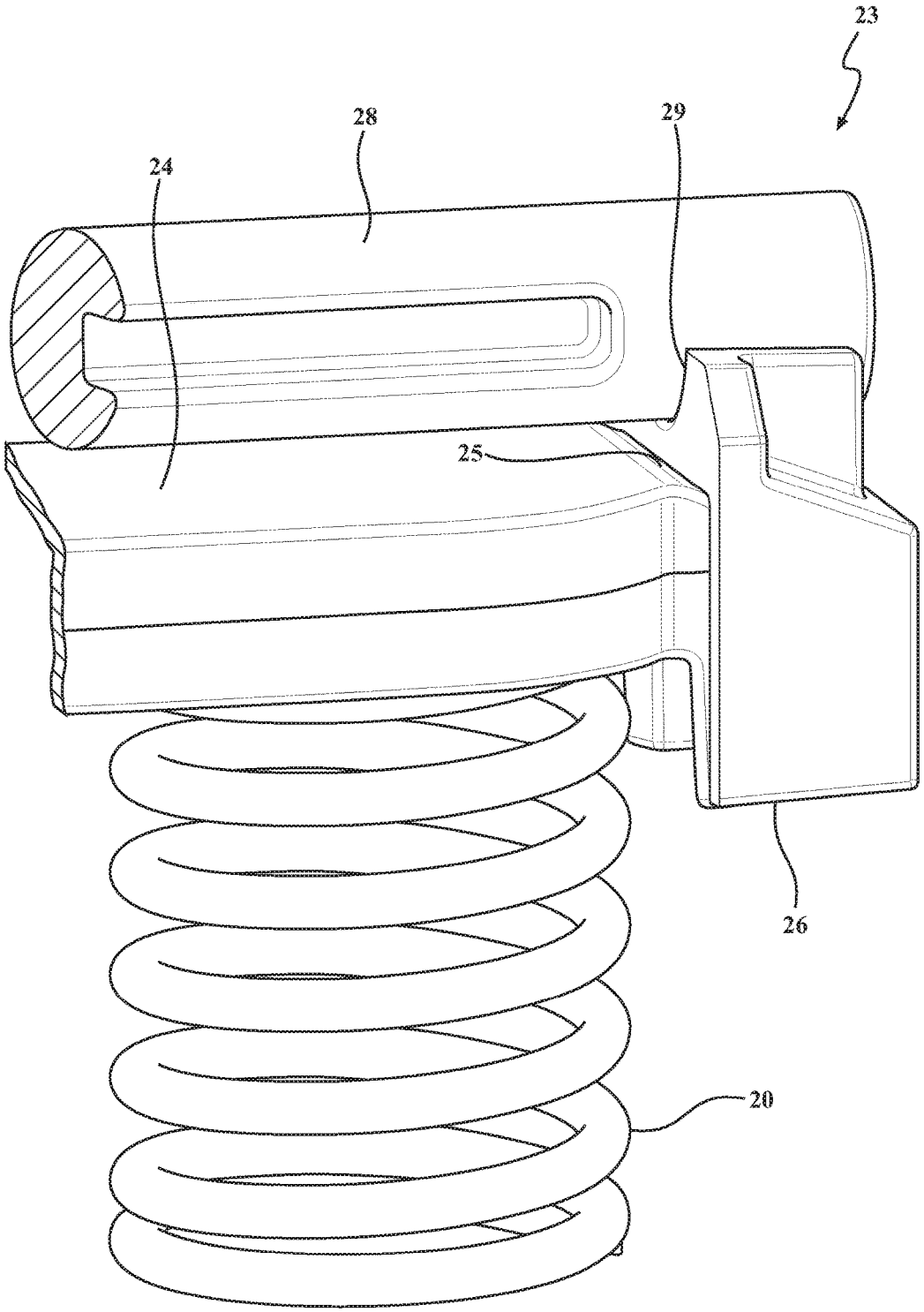
FIG. 5 shows a detailed view of parts of the spring and the frictional mechanism.

FIG. 5 shows a detail of the pedal assembly of the first embodiment namely one end portion of the first frictional mechanism 23. The central member 24 of the first friction mechanism is connected to the upper ends of the spring elements 20. A side member 26 is placed on one end portion of the central member 24 such that the inclined upper wall portion 27 of the side member 26 is in abutment on the inclined margin portion 25 of the central member 24. Transfer pin 28 is received in the semi-cylindrical recesses 29 in the upper portions of the side members 26. This arrangement is also visible in the cross sectional view of FIG. 4 which is taken through the first spring elements 20 and the first friction mechanism. As can be seen the central member 24 of the first friction mechanism 23 rests on the upper ends of spring element 20. The inclined margin portions 25 of the central member 24 carry the side members 26 in a symmetrical manner on both sides such that the inclined margin portions 25 are in abutment with the inclined upper wall portions 27 of the side members 26.

Figure 7:
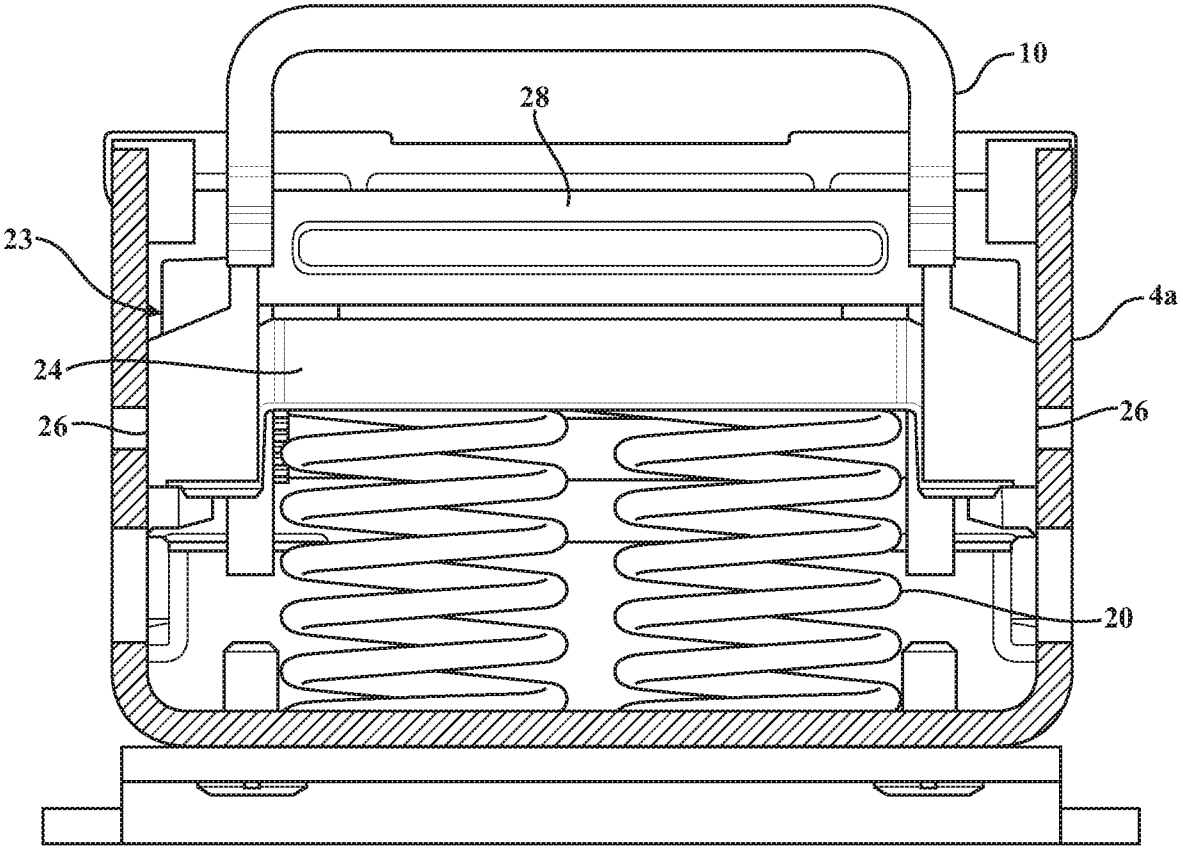
FIG. 7 shows a cross sectional view of the bidirectional pedal assembly of the first embodiment.

The operation of the first frictional mechanism 23 of the pedal assembly according to the first embodiment will be described in connection with FIGS. 4 and 7 and 8. If the pedal 12 and thus the pedal support member 10 are pivoted around shaft 9 in a first direction this pivotal moment is transferred to transfer pin 28 and further transferred to side members 26 and central member 24. During pivotal movement of the pedal support member 10 first spring elements 20 are compressed, as can be seen from FIG. 7 which shows a front view (with the end walls of the housing removed) with the pedal support member 10 being in the rest position, and FIG. 8 which shows the same view after the pedal support member 10 has been pivoted in the first direction which resulted in a downward movement of the first frictional mechanism 23 with its central member 24 and its side members 26 being moved downwardly. This in turn caused compression of first spring elements 20. Due to the force transferred from the pivoting pedal support member 10 through the first frictional mechanism 23, side members 26 have been urged to move outwardly due to the downwardly sloping interface formed between the downwardly inclined side margin portions 25 of the central member 24 and the downwardly inclined upper walls 27 of the side members 26. Thus, when force is transmitted through the first frictional mechanism in downward direction to compress the first spring elements 20 to the side members 26 of the first friction mechanism are urged to move outwardly which in turn results in a pressure force pressing the outer side walls of the side members 26 on the inner walls of the housing bracket 4*a*. This increasing force pressing the side walls of the side members 26 to the inner walls of the housing bracket 4*a* causes an increasing frictional resistance which in turn retards the pivotal movement of the pedal support member 10. The first spring elements 20 are compressed. Accordingly, the further pedal support member 10 is pivoted the more force is acting between the pedal support 10 and the first spring elements 20, and the more force is transferred through the first friction mechanism and in turn the more force is exerted by the side members 26 on the inner walls of the housing bracket 4*a* and the more frictional resistance is created.

In the same way friction is generated when the pedal is released and force from the spring elements is transferred through the frictional mechanisms to the pedal support member to urge it back to its rest position.

As can be seen from the cross sectional view in FIG. 4 the base housing 4*a* is provided with stop surfaces 50 which abut against the upper end portions of the first and second transfer pins when the pedal support member 10 is in its rest position. These stop surfaces 50 limit upward movability of the first and second friction mechanisms 23, 43. For example, if the pedal support member 10 is pivoted from the rest position as shown in FIG. 7 to a state pivoted in a first direction as shown in FIG. 8, the first friction mechanism 23 has been pushed downwardly. The second friction mechanism 43 in turn has been held by the stop surfaces 50 at the same level as it had in the rest position of the pedal support member 10, whereas the end opposite to the end of the pedal support member 10 shown in FIG. 7 has pictured upwardly away from the second frictional mechanism 43 such that the recesses 16 (see FIG. 3) have been lifted up from the transfer pin 48 of the second frictional mechanism 43 which is held in place by the stop surfaces 50 as in the rest position against the bias force of the second spring elements 40.

Figure 8:
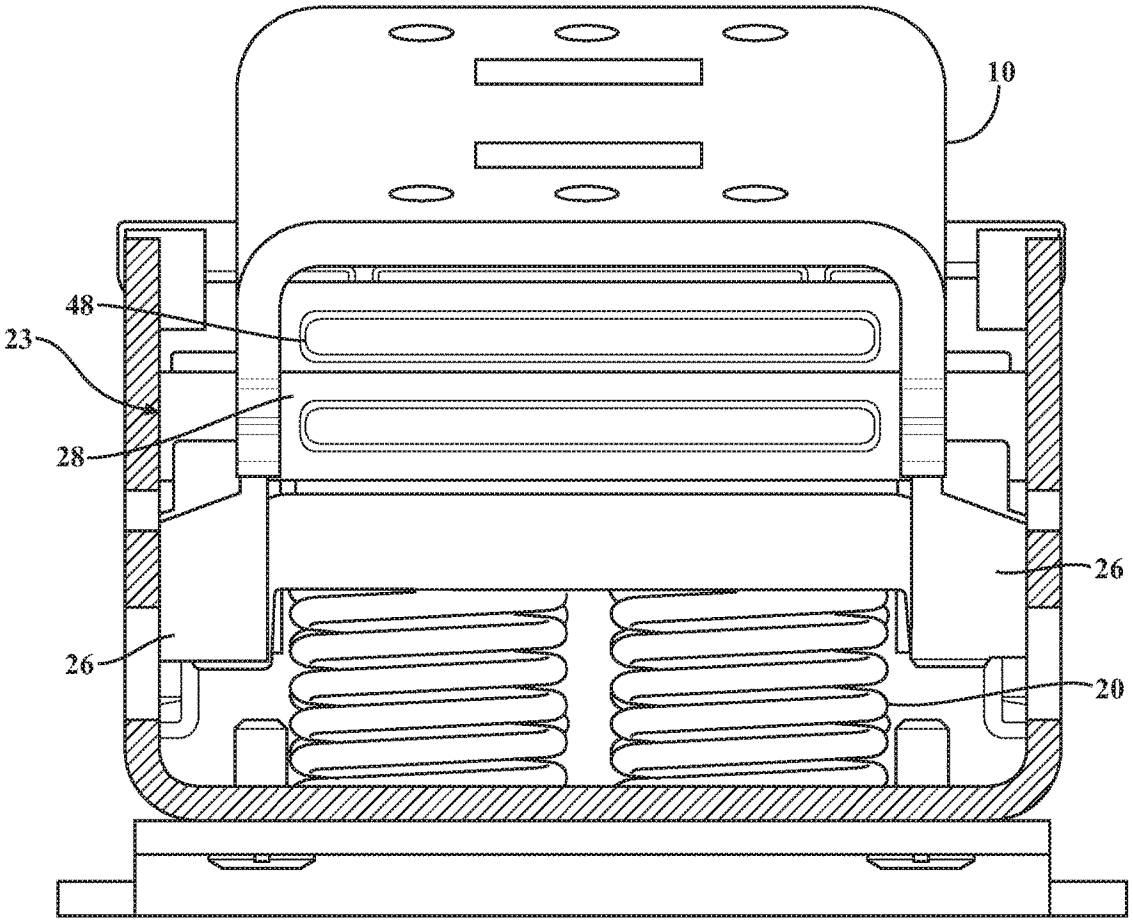
FIG. 8 shows a cross sectional view as in FIG. 7 but with the pedal support member pivoted and the first spring elements compressed.

It is noted that the transfer pin 28, the side members 26 and the central member 24 do not perform a purely linear downward movement when the pedal support member 10 is pivoted from the rest position to the pivoted state as shown in FIG. 8 but a rotational movement around the pivoting shaft 8 on which the pedal support member 10 is mounted in the base housing 4. However, since the pivoting range in typical applications is rather small, for example ±14°, with 0° being the rest position, the deviation from a purely linear downward movement is rather small. In principle the first and second friction mechanism could also be guided for purely linear downward movement, but in this case the semi-circular processes 14, 16 would have to be formed in an elongated manner such that the transfer pins 28 and 48 could also move in longitudinal direction of the pedal support member 10.

Figure 9:
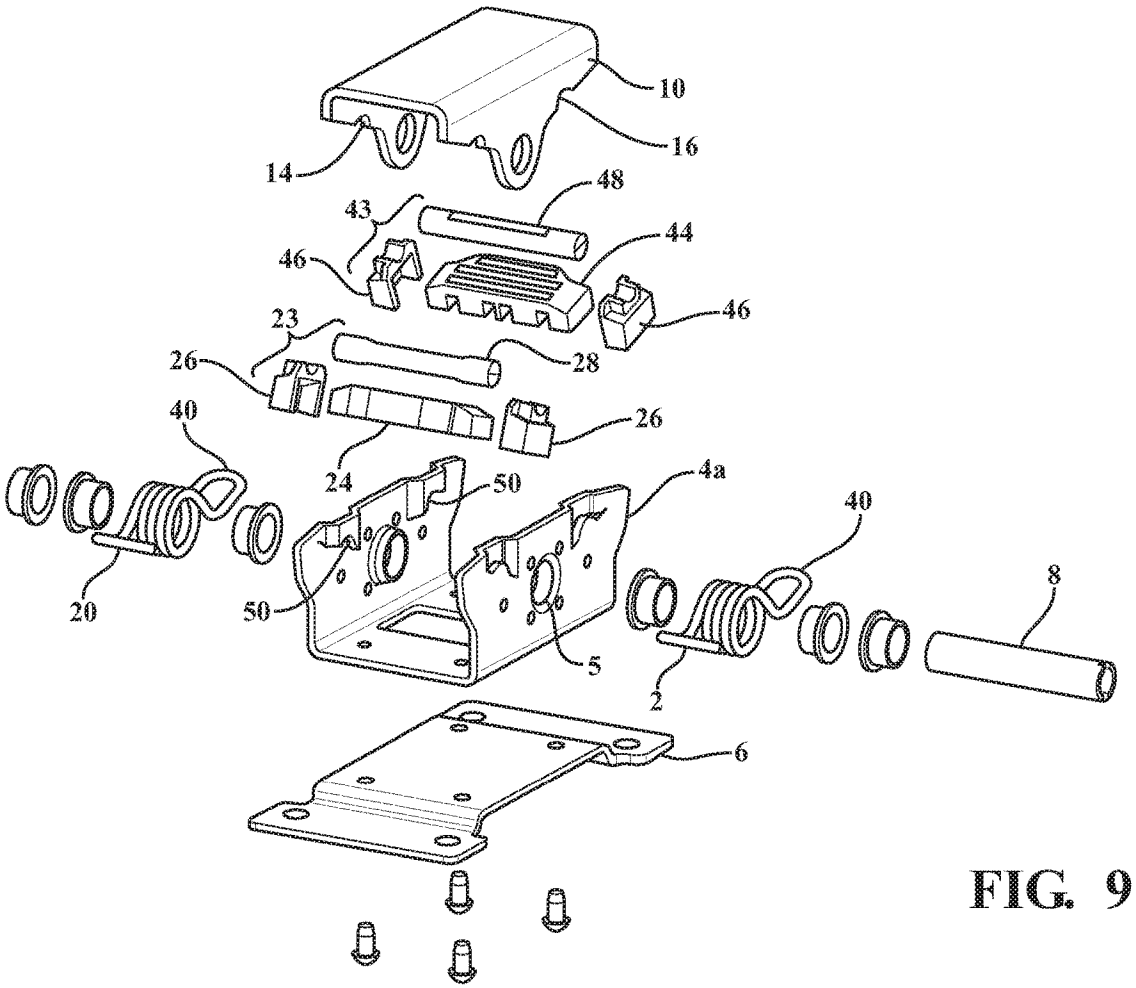
FIG. 9 shows an exploded view of parts of a bidirectional pedal assembly according to a second embodiment.

A second embodiment of a pedal support assembly is described with reference to FIG. 9. Most of the components of the pedal assembly are the same as in the first embodiment as shown in FIG. 3, and therefore some of the components have been omitted in FIG. 9 to simplify the illustration. The design and operation of the pedal support member 10, its pivotal mounting in a housing bracket 4*a* by a shaft 8, and the first and second frictional mechanism 23, 43 are the same as in the first embodiment so that insofar reference can be made to the description of the first embodiment. The difference compared to the first embodiment relates to the spring elements. In the first embodiment compression springs were used as the first and second spring elements acting against pivotal movement of the pedal support member. In the second embodiment these compressions springs have been replaced by torsion springs which are mounted on the shaft 8 and which have end arms extending in opposite directions, wherein the end arms of the spring element 20 extending in one direction are connected to the central member 24 of the first friction mechanism, and the end arms on the spring elements 40 in the other direction are connected to the central member 44 of the second friction mechanism. In this embodiment the first spring elements 20 and the second spring elements 40 share the same physical torsion springs. There are two torsion springs for safety reasons so that the pedal assembly remains operable if one spring fails, for example by breaking. For the same reason there were two compression springs in the first embodiment serving as first spring elements 20 and two compression springs serving as second spring elements 40 so that in case of failure of one spring, the second one would keep the pedal assembly operable.

Figure 10:
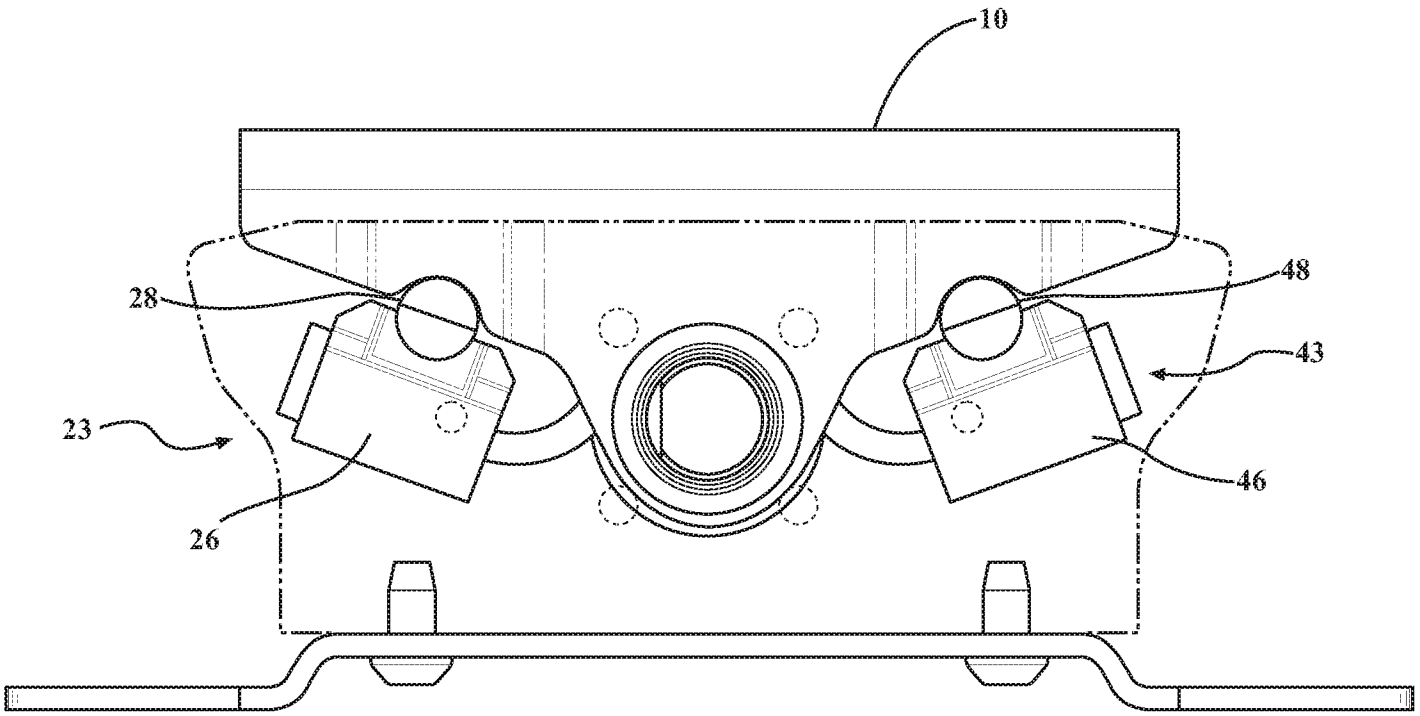
FIG. 10 shows a schematical side view of the pedal assembly according to the second embodiment in its rest position.
Figure 11:
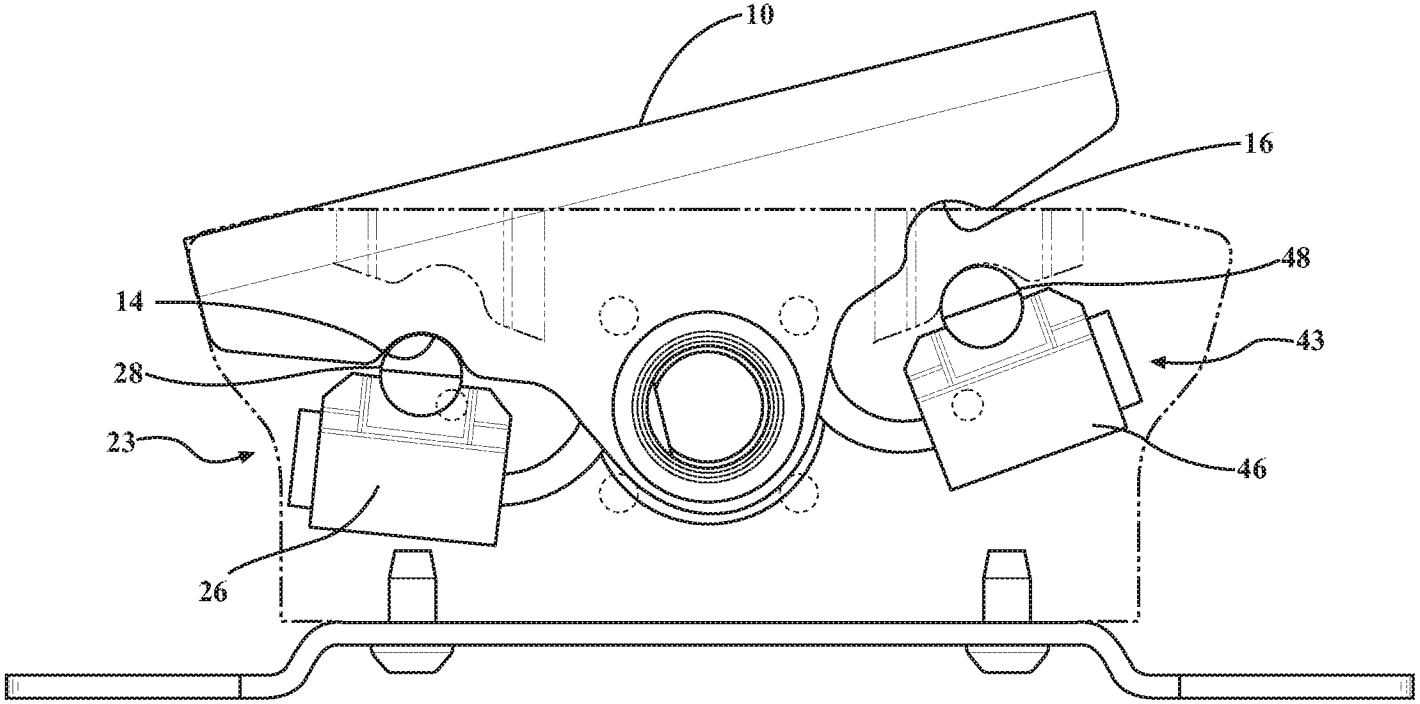
FIG. 11 shows a schematical side view as in FIG. 10 with the pedal support member pivoted in a first direction.
Figure 12:
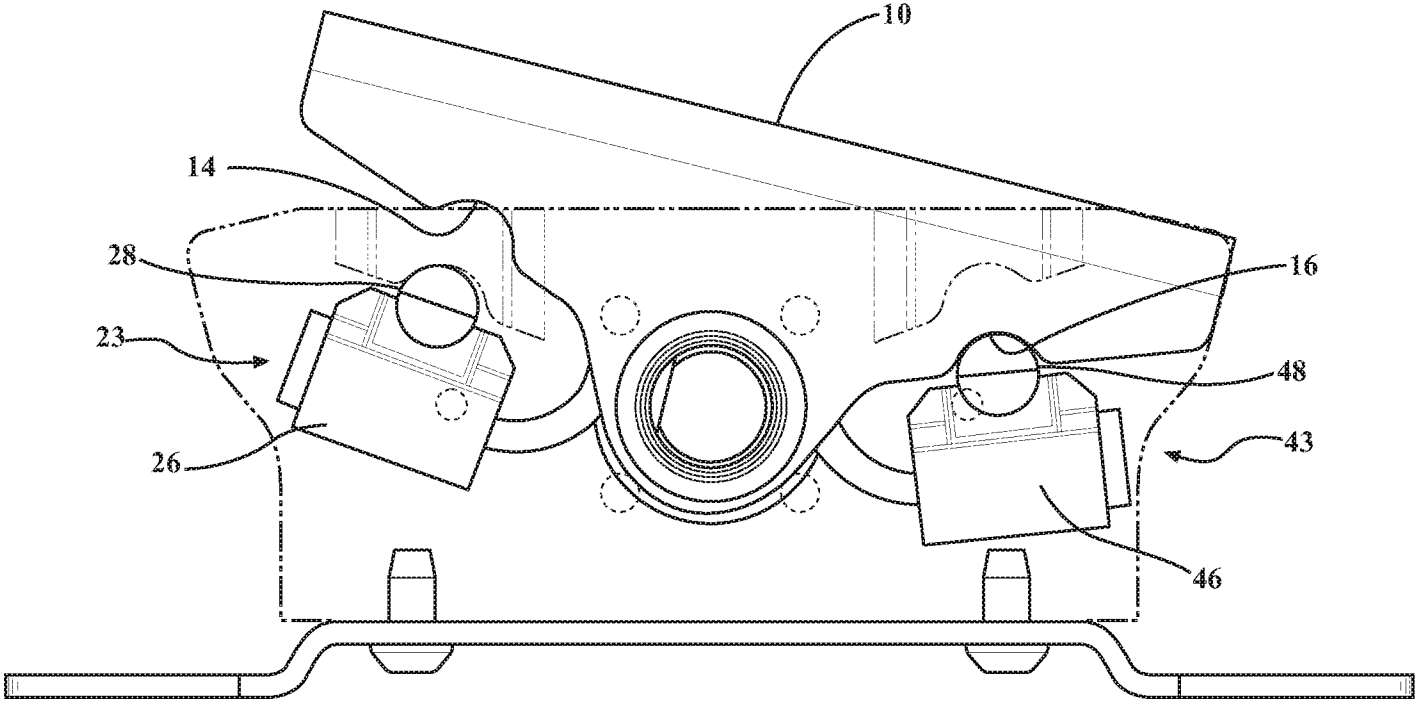
FIG. 12 shows a schematical side view as in FIGS. 10 and 11 with the pedal support member pivoted in the second direction.
Figure 13:
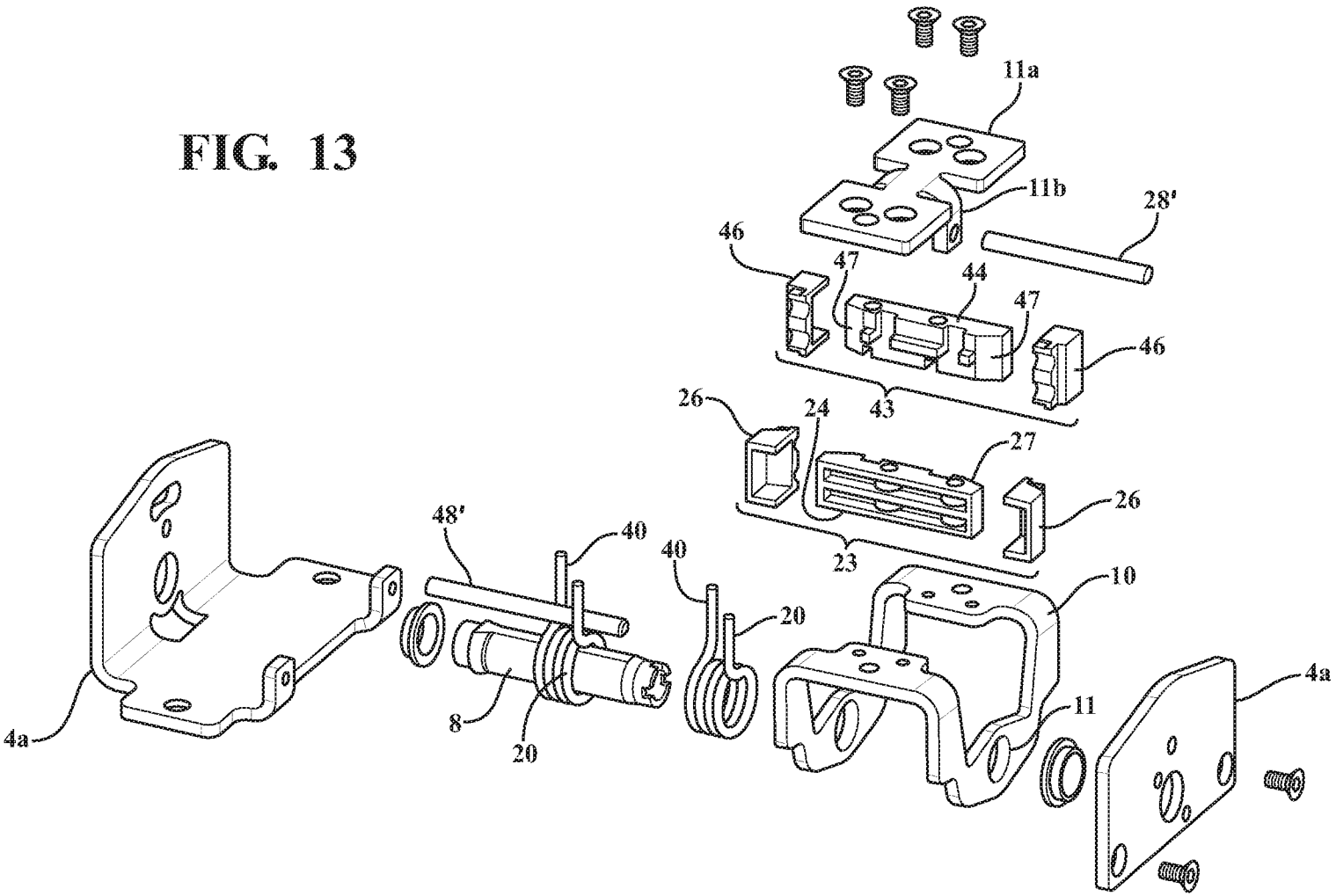
FIG. 13 shows an exploded view of components of a bidirectional pedal assembly according to a third embodiment.

FIGS. 10 to 12 are schematical side views to illustrate the operation of the pedal assembly according to the second embodiment. FIG. 10 shows the pedal assembly in the rest position. FIG. 11 shows the pedal assembly after pivoting the pedal support member in the first direction (the pedal support member in rest position is shown in dash-dotted lines in FIG. 11). By pivoting the pedal support member 10 to the position shown in FIG. 11 the first frictional mechanism 23 has been moved downwardly in the same manner as described for the first embodiment, and an increased frictional force has been created by pressing the side members 26 of the first frictional mechanism 23 outwardly against the inner wall of the base housing (not shown in FIGS. 10 to 12). As can also be seen in FIG. 11 the second friction mechanism 43 remained in the position as it had in the rest position of the pedal support member 10. IN other words the pedal support member 10 with its recess 16 has been lifted off the transfer pin 48 of the second friction mechanism which is held in place by stop surfaces (not shown in FIGS. 10 to 12) which prevent further upward movement of the second frictional mechanism from the position corresponding to the rest position of the pedal support member.

In FIG. 12 the opposite situation is shown, wherein the pedal support member 10 has been pivoted to the opposite second direction to pivot the second frictional mechanism downwardly. In this case the first frictional mechanism has been decoupled from the movement of the pedal support member 10 by limiting the movement of the first friction mechanism to the level corresponding to the rest position of the pedal support member 10 by stop surfaces.

A third embodiment of a bidirectional pedal assembly according to the invention will now be described in connection with FIGS. 13 to 17. Turning first to the exploded view of FIG. 13 it is noted that only those components are shown in this view which differ from the first and second embodiment. Here the housing bracket 4*a* is composed of two parts which are screwed together by screws. Also the pedal support member is composed of two parts 10 and 11*a*, wherein the cover plate 11*a* has two downwardly extending side extensions 11*b* which have a bore in their lower end regions. A transfer pin 28' is received within these bores. A second pin 48' is received within holes in the housing bracket members 4*a*, and is thus fixed with respect to the housing. The transfer pin 28' is in this embodiment fixed to the pivotable pedal support member 10, 11*a*, unlike in the first two embodiments in which the first and second transfer pins were adapted to follow the pivotal movement of the pedal support member, but were decoupled from the pedal support member 10 when one end of the pedal support member 10 moved further upwardly beyond the level corresponding to the rest position.

Similar as before a shaft 8 is mounted in the housing bracket 4*a* for pivotally mounting the pedal support member 10. In addition two torsion springs are mounted in the shaft 8, each with two end portions extending upwardly in vertical direction. These two torsion springs form the first and second spring elements 20, 40, wherein the first and second spring elements share the same physical torsion springs. The end portions of the first spring elements 20 are received in bores of a central member 24 of the first friction mechanism 23. Likewise the end portions of the second spring elements 40 are received in bores of a central member of the second friction mechanism 43. The first friction mechanism 23 further comprises two side members 26, and the second friction mechanism 43 further comprises two side members 46.

The central members 24, 22 again have inclined side margin portions 27 and 47. The side members 26, 46 have a correspondingly inclined side wall portions which come into abutment with the inclined margin portions 27 and 47. A difference compared to the first and second embodiment is that the central members 24, 44 of the first and second friction mechanism 23, 43 are now oriented such that their inclined side margin portions 27 and 47 are facing each other, i.e. compared to the orientation of the first embodiment the first and second friction mechanism 23, 43 are turned by 90 degrees towards each other.

Figure 14:
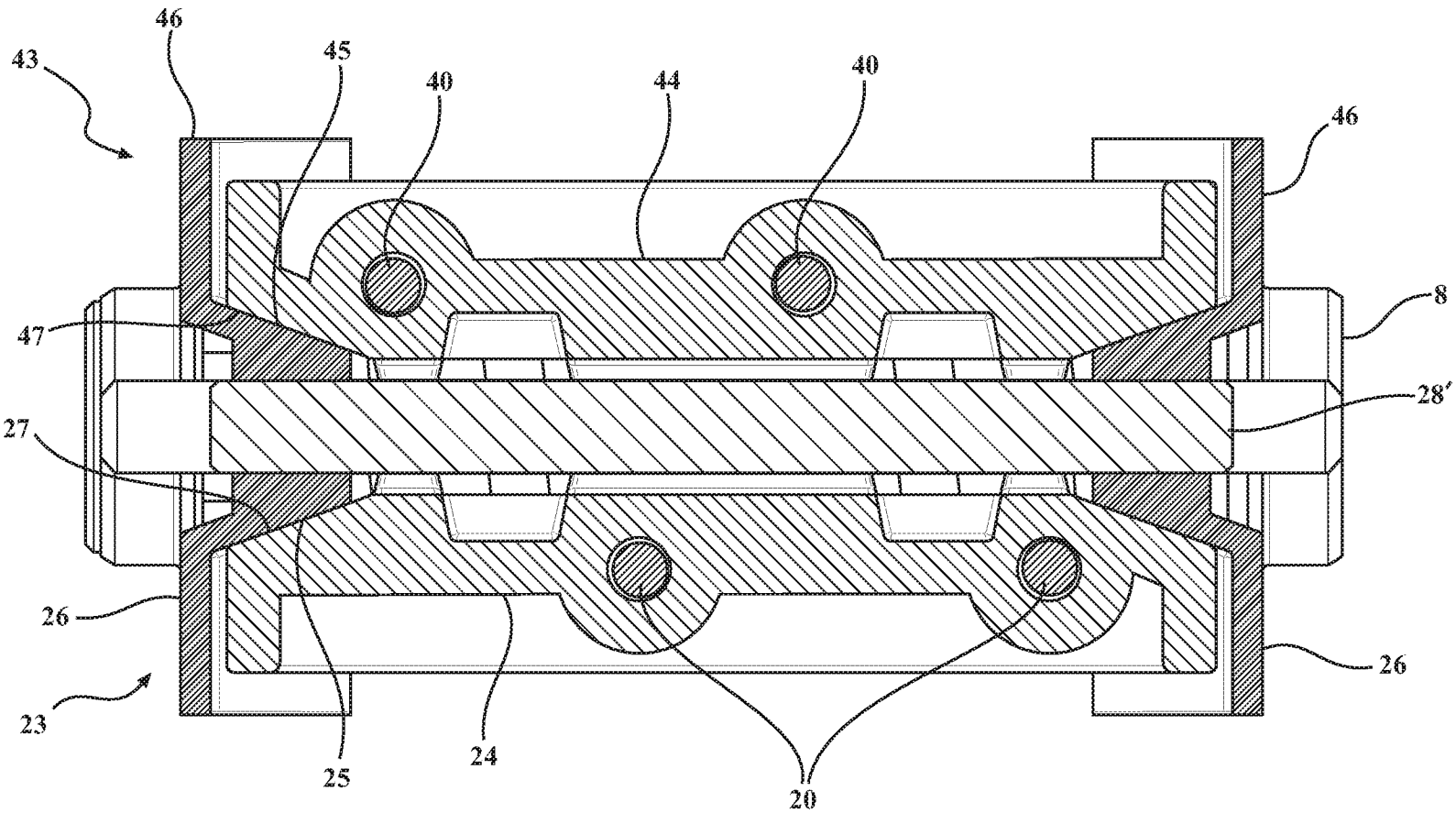
FIG. 14 shows a cross sectional view through the frictional mechanisms of the pedal assembly according to the third embodiment.

FIG. 14 shows a cross sectional view from above taken at the level of the transfer pin 28' and showing the components of the first and second friction mechanism 23, 43 the components of the pedal support member and the base structure being omitted. It can be seen from the cross sectional view of FIG. 14 the central members 24, 44 of the first and second friction mechanism 23, 43 are facing each other with their inclined side margin portions 25 and 45. The side members 26 and 46 are disposed such that their inclined inner side walls 27, 47 are in abutment with the correspondingly inclined margin portions of the central member 24, 44 of the first and second frictional mechanism 23, 43.

Figure 15:
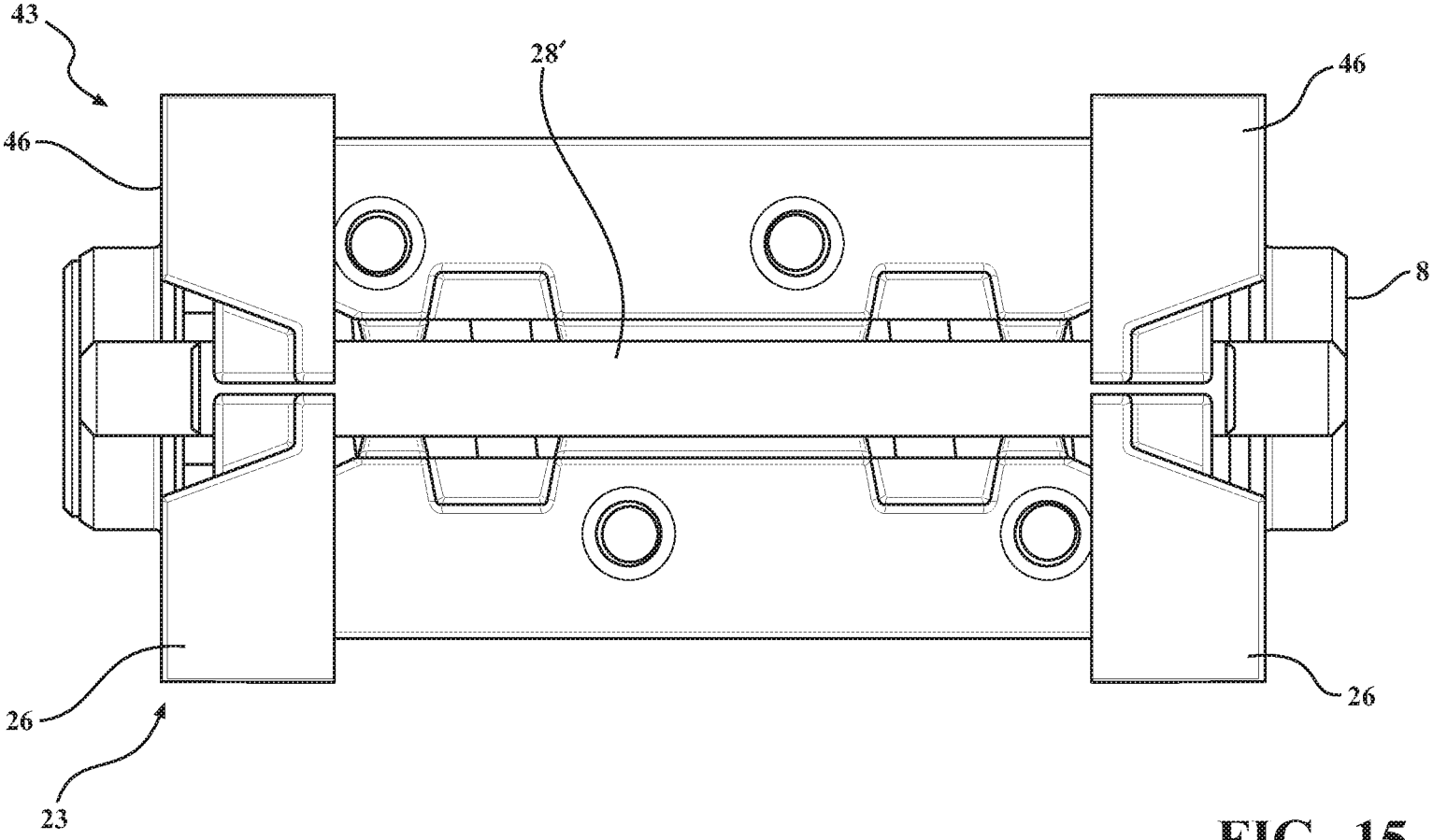
FIG. 15 shows a top view of the frictional mechanisms of the pedal assembly according to the third embodiment.

FIG. 15 shows a top view of the first and second frictional mechanism 23, 43 from above, again with the further components of the pedal support member and the base structure being omitted.

Figure 16:
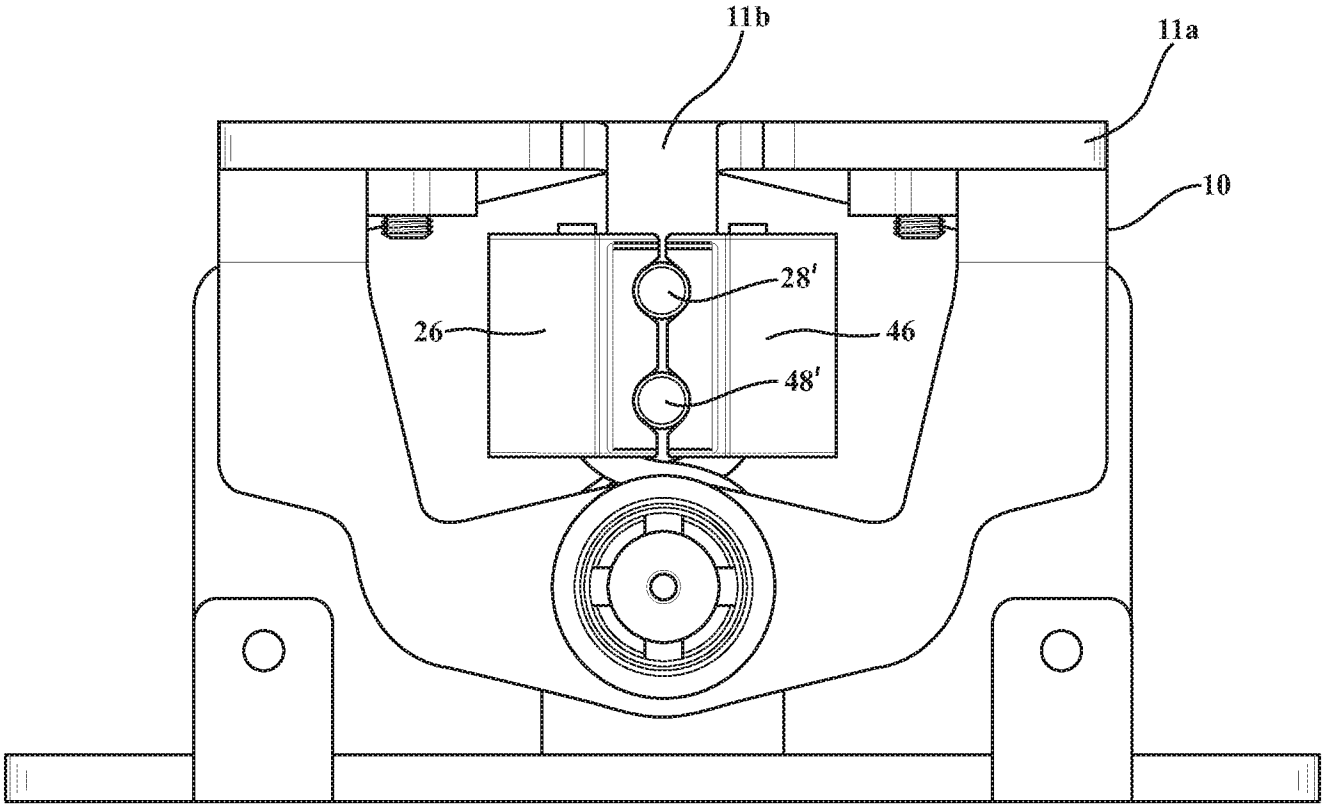
FIG. 16 shows a side view of the pedal assembly according to the third embodiment.
Figure 17:
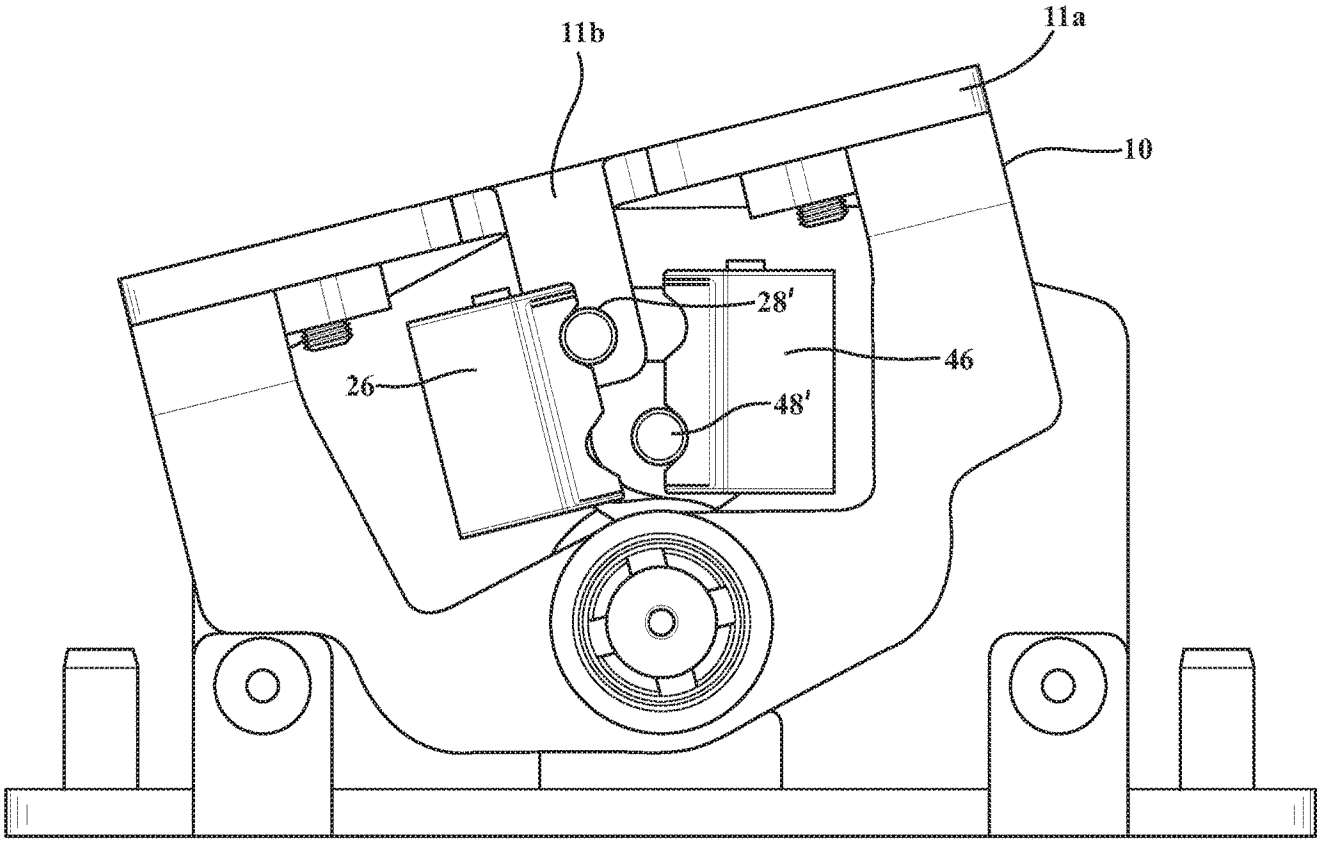
FIG. 17 shows a side view as in FIG. 16 but with the pedal support member pivoted in a first direction.

FIG. 16 and FIG. 17 show side views of the pedal assembly in rest position and with the pedal support assembly member 10 pivoted in a first direction, respectively. As can be seen from these figures, when the pedal support member 10 is pivoted to the left hand side, the transfer pin 28' coupled to the pedal support member 10 urges the side members 26 to follow the pivoting movement, whereby the side members 26 transfer the force exerted by the transfer pin 28' through the central member 24 of the first frictional mechanism 23 to the first spring elements 20 which are thereby tensioned. The force transferred from the transfer pin 28' to the first spring elements through the first frictional mechanism 23 causes, due to the sloping interface between the inclined side margin sloping interface between the inclined side margin portions 25 of the central member 24 and the inclined side wall portions 27 of the sides members 26, an outwardly directed force on the side members 26 which press their side surfaces on the inner wall surface of the housing (not shown in FIGS. 14 to 17), thereby creating an increasing frictional resistance against the movement of the first frictional mechanism 23 and thereby against the movement of the pedal support member 10 and the pedal. This increase of the frictional force between the frictional mechanism and the base structure with increasing pivoting movement of the pedal support member and of the pedal corresponds to the friction increase as described for the first and second embodiment.

In connection with FIGS. 16 and 17 it can be noted that in this embodiment only one transfer in 28' is present which transfers force to the first friction mechanism 23 when the pedal support member 10 is pivoted to the left hand side as in FIG. 17; the same transfer pin 28' exerts force and moves the second friction mechanism 23 with its side members 46 in right hand direction if the pedal support member 10 is pivoted to the right hand side.

The second pin 48' is stationary with respect to the housing of the base structure. The second pin 48' is in this embodiment providing the stop surfaces which prevent movement of the first and second friction mechanisms beyond the position corresponding to their rest positions. For example, in the situation shown in FIG. 17 the second pin 48' keeps the second friction mechanism with its side members 46 in the same position as in the rest position, whereas the first frictional mechanism 23 has been pivoted away together with the pedal support member 10. If the pedal support member 10 is pivoted from the position shown in FIG. 16 to the right hand side, the second pin 48' keeps the first friction mechanism 23 with its side members 26 in the same position as the rest position.

The invention claimed is:

1. A bidirectional pedal assembly comprising:

a base structure connectable to a vehicle structure;

a pedal support member (10) pivotally mounted on the base structure (2) to be pivotable around an axis of rotation from a rest position in a first direction and in a second direction opposite to the first direction;

a first spring element (20) and a second spring element (40) which are tensioned when the pedal support member is pivoted in the first and second direction, respectively, and which urge the pedal support member to the rest position; and a first frictional mechanism (24, 26, 28) and a second frictional mechanism (44, 46, 48) disposed between the pedal support member and the first and second spring elements, respectively, such that, when the pedal support member (10) is pivoted in the first and second directions, one of the first and second frictional mechanisms, respectively, moves with the pedal support member and acts on one of the first and second spring elements (20, 40), respectively, by transmitting force from the pedal support member through one of the first and second frictional mechanisms (24, 26, 28, 44, 46, 48), respectively, to one of the first and second spring elements, and in that each frictional mechanism is arranged to increase a frictional resistance to retard pivotal movements of the pedal support member upon force being transmitted through the one respective frictional mechanism;

wherein each of the first and second frictional mechanisms comprises at least two members (24, 26, 44, 46) which are in abutment with and moveable to each other and which are arranged to be urged apart upon force being transmitted through the one respective frictional mechanism to thereby increase the frictional resistance to retard pivotal movements of the pedal support member (10), and wherein the at least two members (24, 26, 44, 46) of each of the first and second frictional mechanisms comprises inclined surface portions arranged such that, when the at least two members (24, 26, 44, 46) are urged apart by a wedging interaction of the inclined surface portions, at least one surface of one of the at least two members is pressed against a surface which is fixed in relation to the base structure (2) to increase the frictional resistance against pivotal movements of the pedal support member.

2. The bidirectional pedal assembly according to claim 1, wherein the inclined surface portions in abutment with each other are inclined with respect to a plane perpendicular to a direction in which force is transmitted from the pedal support member (10) through the one respective frictional mechanism.

3. The bidirectional pedal assembly according to claim 1 wherein the at least two members of each of the first and second frictional mechanisms comprises a respective one of two central members (24, 44) having inclined margin portions and two opposite side members (26, 46), each having a respective one of the inclined surface portions for abutment on a respective one of the inclined margin portions of the central member and a side portion having an outer surface facing an inner wall surface of the base structure, whereby the central members (24, 44) and the opposite side members (26, 46) are arranged such that, when force is transmitted through the one respective frictional mechanism, the opposite side members are pressed in opposite directions away from the central members such that each of the opposite side members comprises a respective one of outer side surfaces pressed into frictional engagement with inner wall surface portions of the base structure (2).

4. The bidirectional pedal assembly according to claim 3, wherein the central members (24, 44) of a respective one of the first and second frictional mechanisms are connected to the first and second spring elements (20, 40), respectively, and that the pedal support member (10) is arranged to exert force, when pivoted out of the rest position in the first direction or the second direction, on the side members (26, 46) of the first or second frictional mechanism, respectively, which force is transferred via the central members to the first or second spring elements.

5. The bidirectional pedal assembly according to claim 1, further comprising a plurality of stop surfaces (50) that balance the force of the first and second spring elements (20, 40) on the first and second frictional mechanism, respectively, when the first and second frictional mechanism reach their rest position corresponding to the rest position of the pedal support member by abutment of the stop surfaces (50) on the first and second frictional mechanisms (24, 26, 28, 44, 46, 48) to thereby decouple force transfer between the first and second spring elements through the first and second frictional mechanisms to the pedal support member.

6. The bidirectional pedal assembly according to claim 5 wherein the stop surfaces (50) are formed as flanges which are fixed in relation to the base structure.

7. The bidirectional pedal assembly according to claim 1, further comprising a plurality of stop surfaces (50), such that the pedal support member (10), at any point of a pivotal movement path, is urged back to the rest position by the first and second spring elements (20, 40), regardless of any difference in the force exerted by the first and second spring elements, the stop surfaces (50) being arranged such that they decouple force transfer from the first and second spring element to the pedal support member by preventing the first and second frictional (24, 26, 28, 44, 46, 48) mechanisms from moving beyond their rest positions corresponding to the rest position of the pedal support member (10).

8. The bidirectional pedal assembly according to claim 7 wherein the stop surfaces (50) are formed as flanges which are fixed in relation to the base structure.

9. The bidirectional pedal assembly according to claim 1, wherein the first and second frictional mechanisms each comprise a transfer pin (28, 48) which abuts on a member of the at least two members of the first and second frictional mechanisms and is received in recesses in surface portions of the member, and that the pedal support member is arranged to abut against and to exert force on the transfer pin (28, 48) of the first and second frictional mechanisms when being pivoted in the first and opposite second directions, respectively.

10. The bidirectional pedal assembly according to claim 1, wherein the at least two members of each of the first and second frictional mechanisms comprises a respective one of two central members (24, 44) having inclined margin portions on opposite sides and two opposite side members (26, 46), each side member having a respective one of the inclined surface portions in abutment on a respective one of said margin portions of the central members (24, 44) and having a side elongation comprising an outer side wall, wherein the central member (24, 44) and the opposite side members (26, 46) are arranged such that, when force is transmitted through one of the respective frictional mechanisms, the two opposite side members are pressed in opposite directions away from the central members and thereby pressed with the outer side wall into frictional engagement with a surface portion being fixed in relation to the base structure.

11. The bidirectional pedal assembly according to claim 10, wherein the central members (24, 44) of each of the first and second frictional mechanisms are connected to the first and second spring elements (20, 40) and that the pedal support member is arranged to exert force, when pivoted out of the rest position in a first or opposite second direction, on the side members (26, 46) of the first or second frictional mechanism, which force is transferred via the central members (24, 44) to the first or second spring elements (20, 40).

12. The bidirectional pedal assembly according to claim 11, wherein the first and second frictional mechanisms each comprise a transfer pin (28, 48) which extends between the side members (26, 46) and is received in recesses in surface portions of the side members which are facing the pedal support member, and that the pedal support member (10) is arranged to abut against and to exert force on the transfer pin (28, 48) of the first and second frictional mechanisms, respectively, when the pedal support is pivoted in the first and opposite second directions, respectively.

13. The bidirectional pedal assembly according to claim 1, wherein each of the first and second frictional mechanisms comprises a respective one of two transfer pins which is fixed to the pedal support member to extend between the adjacent first and second frictional mechanisms and to exert force on the first and second frictional mechanisms when the pedal support member is pivoted in the first and second directions respectively.

14. The bidirectional pedal assembly according to claim 13, wherein the at least two members of each of the first and second frictional mechanisms comprises a respective one of two central members (24, 44) having inclined margin portions on opposite sides and two opposite side members (26, 46), the central members being oriented such that the inclined margin portions are facing, each side member having a respective one of the inclined surface portions in abutment on a respective one of said margin portions of the central members and having a side elongation presenting an outer side wall, wherein the central members and the opposite side members are arranged such that, when force is transmitted through one of the respective frictional mechanism, the two opposite side members are pressed in opposite directions away from the central members and thereby pressed with the outer side wall into frictional engagement with a surface portion being fixed in relation to the base structure.

15. The bidirectional pedal assembly according to claim 13, wherein a pin fixed to the base structure is disposed to extend between the first and second frictional mechanisms and to abut against portions of the first and second frictional mechanisms when the pedal support member is in the rest position such that opposite surface portions of the pin form stop surfaces for the first and second frictional mechanisms.

16. A bidirectional pedal assembly for a vehicle comprising:

a base structure adapted to be connected to a vehicle structure of the vehicle;

a pedal support member (10) pivotally mounted on the base structure (2) to be pivotable around an axis of rotation from a rest position in a first direction and in a second direction opposite to the first direction;

a first spring element (20) and a second spring element (40) that are tensioned when the pedal support member is pivoted in the first and second direction, respectively, and urge the pedal support member to the rest position; and a first frictional mechanism (24, 26, 28) and a second frictional mechanism (44, 46, 48) disposed between the pedal support member and the first and second spring elements, respectively, such that, when the pedal support member (10) is pivoted in the first and second directions, one of the first and second frictional mechanisms, respectively, moves with the pedal support member and acts on one of the first and second spring elements (20, 40), respectively, by transmitting force from the pedal support member through one of the first and second frictional mechanisms (24, 26, 28, 44, 46, 48), respectively, to one of the first and second spring elements, and each frictional mechanism is arranged to increase a frictional resistance to retard pivotal movements of the pedal support member upon force being transmitted through the one respective frictional mechanism;

wherein each of the first and second frictional mechanisms comprises at least two members (24, 26, 44, 46) having inclined surface portions in abutment with each other such that the at least two members (24, 26, 44, 46) are urged apart by a wedging interaction of the inclined surface portions.

17. The bidirectional pedal assembly according to claim 16 wherein each of the first and second frictional mechanisms comprises at least two members (24, 26, 44, 46) in abutment with and moveable to each other, and are arranged to be urged apart upon a force being transmitted through the one respective frictional mechanism to increase the frictional resistance to retard pivotal movements of the pedal support member (10).

18. The bidirectional pedal assembly according to claim 16, wherein the inclined surface portions in abutment with each other are inclined with respect to a plane perpendicular to a direction in which the force is transmitted from the pedal support member (10) through the one respective frictional mechanism.

19. The bidirectional pedal assembly according to claim 16 wherein the at least two members of each of the first and second frictional mechanisms comprises a respective one of two central members (24, 44) having inclined margin portions and two opposite side members (26, 46), each having a respective one of the inclined surface portions for abutment on a respective one of the inclined margin portions of the central member and a side portion having an outer surface facing an inner wall surface of the base structure, whereby the central members (24, 44) and the opposite side members (26, 46) are arranged such that, when a force is transmitted through the one respective frictional mechanism, the side members are pressed in opposite directions away from the central members such that each of the opposite side members comprises a respective one of outer side surfaces pressed into frictional engagement with inner wall surface portions of the base structure (2).

20. The bidirectional pedal assembly according to claim 19, wherein each of the central members (24, 44) of a respective one of the first and second frictional mechanisms is connected to the first and second spring elements (20, 40), respectively, and the pedal support member (10) is arranged to exert the force, when the pedal support member (10) pivoted out of the rest position in the first direction or the second direction, on the side members (26, 46) of the first or second frictional mechanism, respectively, which the force is transferred by the central member to the first or second spring elements.

21. The bidirectional pedal assembly according to claim 16, further comprising a plurality of stop surfaces (50) that balance the force of the first and second spring elements (20, 40) on the first and second frictional mechanism, respectively, when the first and second frictional mechanism reach their rest position corresponding to the rest position of the pedal support member by abutment of the stop surfaces (50) on the first and second frictional mechanisms (24, 26, 28, 44, 46, 48) to thereby decouple a force transfer between the first and second spring elements through the first and second frictional mechanisms to the pedal support member.

22. The bidirectional pedal assembly according to claim 16, further comprising a plurality of stop surfaces (50), such that the pedal support member (10), at any point of a pivotal movement path, is urged back to the rest position by the first and second spring elements (20, 40), regardless of any difference in the force exerted by the first and second spring elements, the stop surfaces (50) being arranged such that they decouple force transfer from the first and second spring elements to the pedal support member by preventing the first and second frictional (24, 26, 28, 44, 46, 48) mechanisms from moving beyond their rest positions corresponding to the rest position of the pedal support member (10).

23. The bidirectional pedal assembly according to claim 22 wherein the stop surfaces (50) are formed as flanges which are fixed in relation to the base structure.

24. The bidirectional pedal assembly according to claim 16, wherein each of the first and second frictional mechanisms each a comprises a respective one of two transfer pins (28, 48) which abuts opposite side members (26,46) respectively, and is received in recesses in surface portions of the side members (26, 46), and that the pedal support member is arranged to abut against and to exert force on the transfer pin (28, 48) of each of the first and second frictional mechanisms when being pivoted in the first and opposite second directions, respectively.

25. The bidirectional pedal assembly according to claim 16, wherein the at least two members of each of the first and second frictional mechanisms comprises a (24, 44) having inclined margin portions on opposite sides and two opposite side members (26, 46), each side member having a respective one of the inclined surface in abutment on a respective one of said margin portions of the central members (24, 44) and having a side elongation comprising an outer side wall, wherein the central members (24, 44) and the opposite side members (26, 46) are arranged such that, when the force is transmitted through the one respective frictional mechanism, the side members are pressed in opposite directions away from the central members and thereby pressed with the outer side wall into frictional engagement with a surface portion being fixed in relation to the base structure.

* * * * *